US007094140B2

(12) United States Patent
Palushi et al.

(10) Patent No.: US 7,094,140 B2
(45) Date of Patent: Aug. 22, 2006

(54) ABRASIVE SANDING SURFACE

(75) Inventors: Simon Palushi, Shelby Township, MI (US); Howard Goldberg, Newburgh, NY (US)

(73) Assignee: OnFloor Technologies, L.L.C., Newburgh, NY (US)

( * ) Notice: Subject to any disclaimer, the term of this patent is extended or adjusted under 35 U.S.C. 154(b) by 0 days.

(21) Appl. No.: 11/042,392

(22) Filed: Jan. 25, 2005

(65) Prior Publication Data

US 2005/0124270 A1 Jun. 9, 2005

Related U.S. Application Data

(63) Continuation-in-part of application No. 10/453,310, filed on Jun. 3, 2003, now abandoned.

(51) Int. Cl.
*B24B 33/00* (2006.01)

(52) U.S. Cl. ..... 451/548; 451/510; 451/521; 451/353

(58) Field of Classification Search ..... 451/548–550, 451/490, 509, 510, 514, 515, 520–522, 353, 451/360
See application file for complete search history.

(56) References Cited

U.S. PATENT DOCUMENTS

| | | | | |
|---|---|---|---|---|
| 2,201,196 | A | 5/1940 | Williamson | |
| 2,740,239 | A | 4/1956 | Ball et al. | |
| 2,778,169 | A | 1/1957 | Ball | |
| 2,876,086 | A | 3/1959 | Raymond | |
| 3,092,937 | A * | 6/1963 | Tocci-Guilbert | 451/509 |
| 3,315,420 | A * | 4/1967 | Moberg | 451/510 |
| 3,466,877 | A * | 9/1969 | Foley et al. | 405/205 |
| 3,491,494 | A * | 1/1970 | Mackay, Jr. | 451/509 |
| 3,860,400 | A | 1/1975 | Prowse et al. | |
| 3,869,263 | A | 3/1975 | Greenspan | |
| 3,918,217 | A | 11/1975 | Oliver | |
| 3,974,598 | A * | 8/1976 | Guidry | 451/490 |
| 4,010,583 | A | 3/1977 | Highberg | |
| 4,047,902 | A | 9/1977 | Wiand | |
| 4,114,322 | A | 9/1978 | Greenspan | |
| 4,282,011 | A | 8/1981 | Terpay | |
| 4,285,171 | A | 8/1981 | Block et al. | |
| 4,668,248 | A | 5/1987 | Dettelbach et al. | |
| 4,836,832 | A | 6/1989 | Tumey et al. | |
| 4,916,869 | A | 4/1990 | Oliver | |
| 4,925,457 | A | 5/1990 | deKok et al. | |
| 4,964,884 | A | 10/1990 | Jurissen et al. | |
| 4,974,373 | A | 12/1990 | Kawashima et al. | |
| 5,131,924 | A | 7/1992 | Wiand | |
| 5,203,881 | A | 4/1993 | Wiand | |
| 5,209,760 | A | 5/1993 | Wiand | |
| 5,232,470 | A | 8/1993 | Wiand | |
| 5,567,503 | A | 10/1996 | Sexton et al. | |

(Continued)

OTHER PUBLICATIONS

Superabrasive Catalogue 2003.

*Primary Examiner*—Dung Van Nguyen
(74) *Attorney, Agent, or Firm*—Reising, Ethington, Barnes, Kisselle, P.C.

(57) ABSTRACT

An abrasive sandpaper system having a backing plate (16) with a canted outer periphery (28) and an off-centered aperture (26) for interlocking with lugs (18) of a power driver (12). The sandpaper (30) has a canted outer periphery (38) for riding over raised edges (45) of an uneven wood deck. The backing plate may have a pocket (50) with a side wall (60) to receive the substrate layer (58) of sandpaper (54).

4 Claims, 3 Drawing Sheets

U.S. PATENT DOCUMENTS 5,947,807 A * 9/1999 Overseth ..... 451/533
6,123,612 A 9/2000 Goers
6,190,246 B1 2/2001 Parrott et al.
6,227,959 B1 * 5/2001 Beaudry ..... 451/526
6,312,325 B1 11/2001 Van Osenbruggen
6,361,424 B1 * 3/2002 Manor et al. ..... 451/490
6,368,198 B1 4/2002 Sung et al.
6,394,887 B1 * 5/2002 Edinger ..... 451/494
6,530,830 B1 3/2003 Rich et al.
2004/0127151 A1 * 7/2004 Takizawa et al. ..... 451/490

* cited by examiner

ABRASIVE SANDING SURFACE

This application is a continuation-in-part of U.S. Ser. No. 10/453,310 filed on Jun. 3, 2003 now abandoned

TECHNICAL FIELD

This field of this invention relates to abrasive sheet material and more particularly to abrasive discs for power tools and a non-slip drive.

BACKGROUND OF THIS DISCLOSURE

Abrasive materials have long been used for grinding and polishing. The abrasive material wears down the surface of the work by a cutting action. Rough surfaces, rough edges or tarnish or other weathered coating can be removed by the abrasive action.

It is also common to bind the abrasive material on a substrate or backing in order to have a handy easy to use abrasive tool. Often abrasive tools are desired over sandblasting or other spray or rubbing techniques of loose abrasive materials. One of the advantages is better cleanup and less dust or mess left over due to loose abrasive grit.

One common abrasive tool is often referred to as sandpaper which has sand or other grit element bonded onto a paper type backing. Sand paper is both used manually and in power tools such as orbital, random or belt tools. While sandpaper is a very popular media for abrading many materials especially wood, it has its problem of durability.

Durability can be curtailed if the edge of a sandpaper disc encounters a raised strip of wood in a wood deck. Wood decks are made from a plurality of individual strips or slats of wood which often can vary in height enough to allow the edge of one strip of wood to hit the side or lop of the sandpaper rather than the abrasive surface. When this happens, the wood may cut into or otherwise rip the sandpaper which then needs to be immediately replaced.

Furthermore, the aggressiveness of sandpaper may be limited by the extent of the slipping with the drive mechanism. The sandpaper often provides for greater friction between the abrasive surface and the work surface than the back of the sandpaper has with the drive mechanism. The sandpaper can then get stuck with the wood or other work surface and slips with respect to the drive mechanism.

What is needed is a sandpaper system with a non-slip drive mechanism and as canted outer periphery for increasing the efficiency and durability of the sandpaper.

SUMMARY OF THE DISCLOSURE

In accordance with one aspect of the invention, an abrasive sandpaper system for a power tool includes a backing plate constructed to be mounted on a driver of a power tool with a positive interlocking device. A semi-rigid substrate that retains its shape when not flexed under load is removably mountable to the backing plate. The substrate has an abrasive surface being made from hard grit particles that are affixed onto said substrate. Preferably, the backing plate has at least one off-centered aperture for interlocking with complementarily shaped off-centered lugs on the driver. In one embodiment, the lug's height is no greater than the aperture's height in the backing plate. Preferably, the backing plate and the substrate have complementary hook and loop fasteners to non-slidably and removably fasten the substrate to the backing plate.

It is preferred that the backing plate and the substrate both have a periphery canted away from the abrasive surface.

In accordance with another aspect of the invention, an abrasive sandpaper pad for a power tool includes a backing plate with a central pocket for receiving a sandpaper layer. An outer periphery surrounds the pocket forming a side wall of the pocket. The outer periphery is also canted upwardly. The pocket has a sufficient depth to receive a fastener device for securing the sandpaper to the backing plate, a substrate layer of the sandpaper and to expose an abrasive layer of the sandpaper below said side wall. It is desired that the fastener device includes complementary hook and loop layers adhered to the pocket and to the substrate layer of the sandpaper.

BRIEF DESCRIPTION OF THE DRAWINGS

Reference now is made to the accompanying drawings in which.

DETAILED DESCRIPTION OF THE PREFERRED EMBODIMENT

Figure 1:
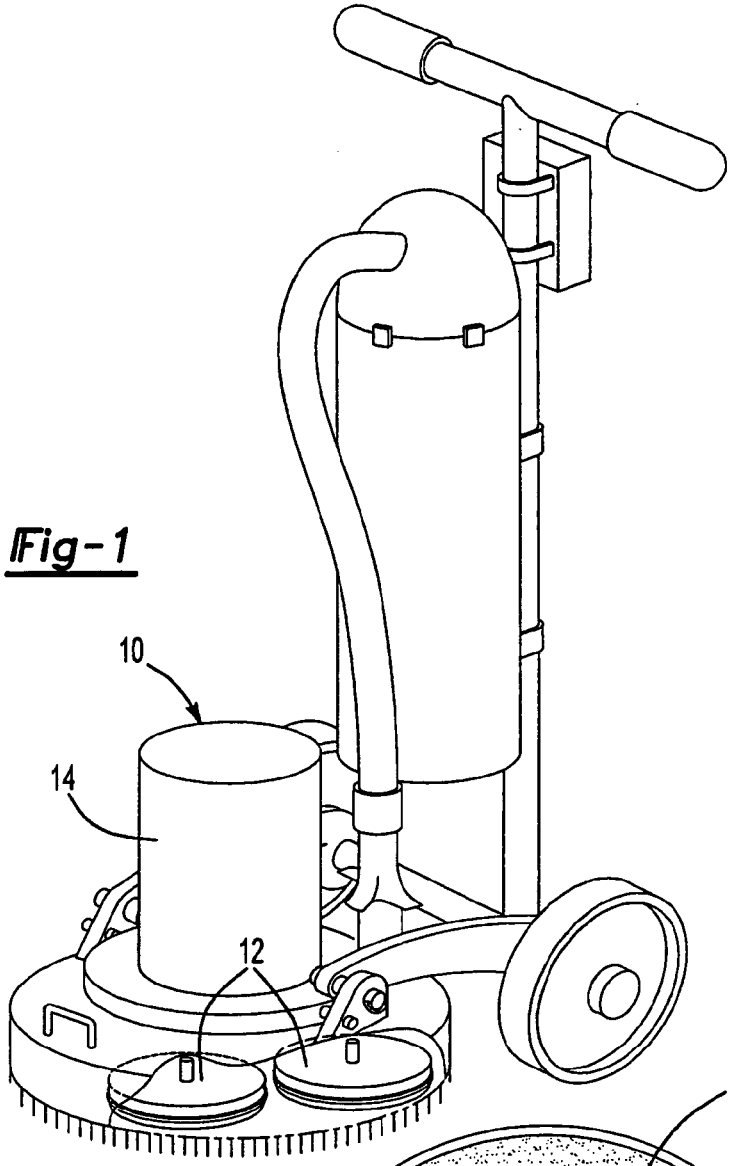
FIG. 1 is a perspective view of power sander using one embodiment of a driver and sandpaper in accordance with the invention.
Figure 2:
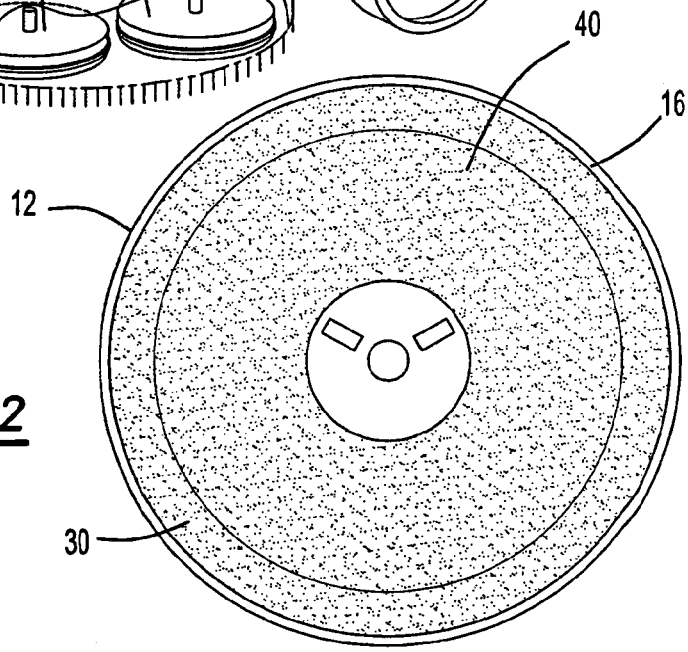
FIG. 2 is a plan view of a driver and sandpaper in accordance with the invention.
Figure 3:
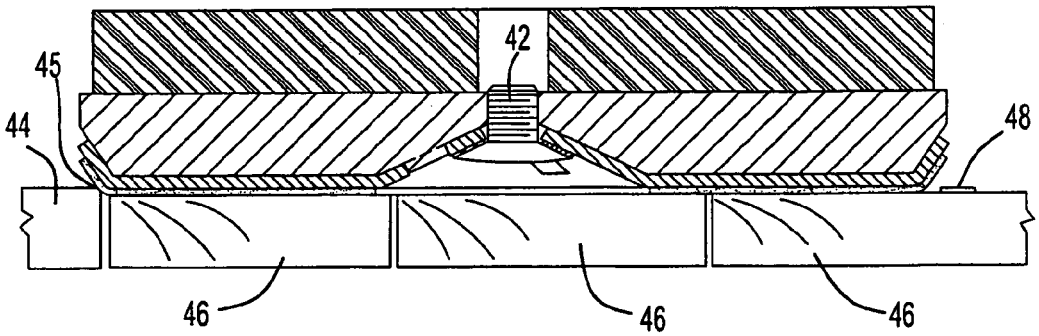
FIG. 3 is a cross-sectional view of the sandpaper shown in FIG. 2 shown in place with a backing plate and driver and in use on a wood deck.
Figure 4:
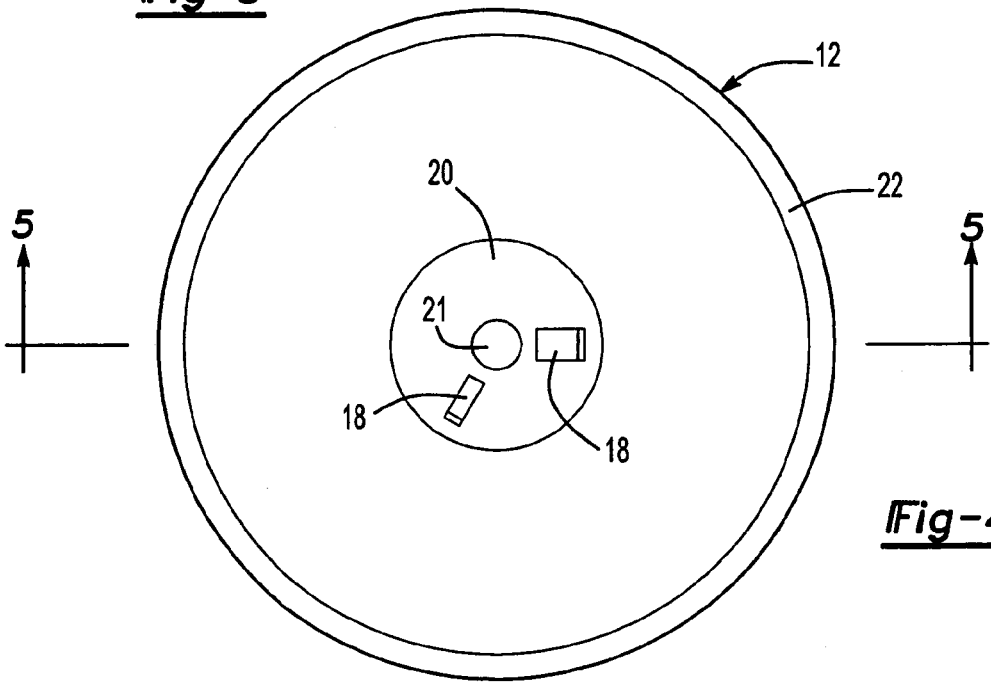
FIG. 4 is a plan view of the driver shown in FIG. 1.
Figure 5:
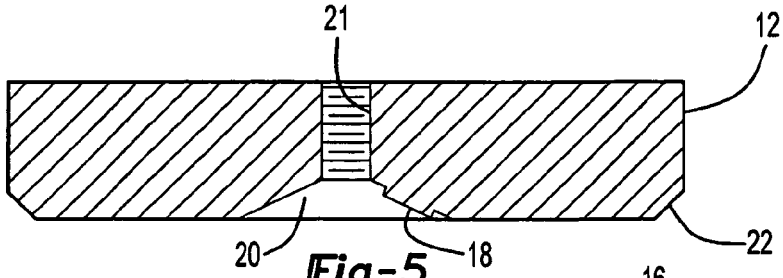
FIG. 5 is a cross-sectional view taken along lines 5—5 shown in FIG. 4.
Figure 6:
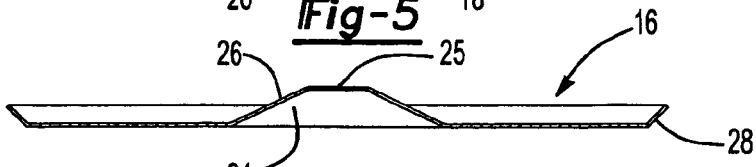
FIG. 6 is a cross-sectional view of the backing plate shown in FIG. 3.

Referring now to FIG. 1, a power sander 10 has a plurality of drivers 12 conventionally mounted to and driven by a motor 14. The drivers 12, as shown in FIGS. 2 and 3, may have a contoured backing plate 16 secured thereon. The driver 12 may have two off-centered lugs 18 spaced 90° apart on a beveled interior centered area 20 that has a central thread aperture 21 for securing bolt 42. The backing plate 16 has a complementary beveled central area 24 with a central aperture 25 for passing through bolt 42 and two off-centered apertures 26 shaped and sized to receive the lugs 18. The lugs have a width to be snugly received in the apertures 26 such that the lugs abut both radial sides of the apertures 26 simultaneously. The thickness or height of the lugs 18 is no greater than the depth of the aperture 26 through of the backing plate 22. The backing plate 16, as clearly shown in FIG. 6, has an outer periphery 28 bent upwardly between 35° and 45° and seats against a complementarily canted periphery 22 of driver 12.

Figure 7:
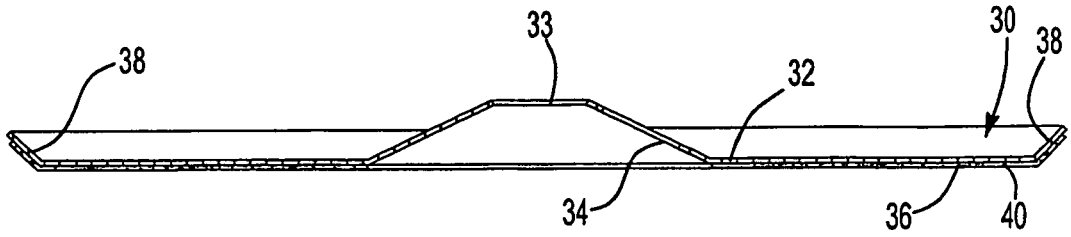
FIG. 7 is a cross-sectional view of the sandpaper shown in FIG. 3.

Referring now to FIG. 7 an abrasive sandpaper 30 is formed from a standard backing layer 32. The sandpaper 30 may have a disc shape with a central mounting aperture 34 and has an annular flat sanding section 36 and an outer periphery 38 being bent upward or away from the annular flat section 36. The outer periphery can extend upward approximately ½" and is at the same 35°–45° cant as the backing plate outer periphery 28. The abrasive 40 secured thereto may be sand or diamond particles or other known abrasive grit. The paper layer 32 is stiffened in the contoured form by a hardened plastic resin. The paper layer 32 has a central aperture 33 for passing bolt 42. The sandpaper disc can be used for rough sanding and abrasive projects such as wood decks where uneven wood or exposed nail heads may be encountered. In use, as shown in FIG. 2, the sandpaper disc 30 may be mounted to a power tool driver 12 via a standard mounting bolt 42 to a standard power tool 10. Any raised piece of wood 44 compared to other slats 46 of wood can be overridden by the angled and canted outer periphery 38 of sandpaper 30. In other words, the sandpaper 30 rides over the raised edge 45 of wood 44. Furthermore, any nail head 48 can also be successfully encountered and overridden without the outer edge being ripped.

It is preferred that the lugs 18 are positioned in an asymmetrical position to prevent backing plates and/or sandpaper, without the appropriate positioned apertures 26, from being balanced thereon. If a backing plate without apertures 26 is mounted, the tightening of the bolt 42 causes the plate 16 to cant and be noticeably out of position. This allows a unique proprietary drive position for different brands.

The backing layer 32 of the sandpaper may be provided with an adhered Velcro or other hook and loop or other high friction fastener to fasten the sandpaper 30 to the backing plate 16. The backing plate 16 may be bonded or adhered to a complementary section of the hook and loop fastener. Thus any undesirable slippage of the sandpaper 30 with the backing plate 16 is minimized.

The connection between the backing plate 16 and the driver 12 is also minimized against slippage by the positive interconnection with the aperture 26 and lugs 18 of the driver.

Figure 8:
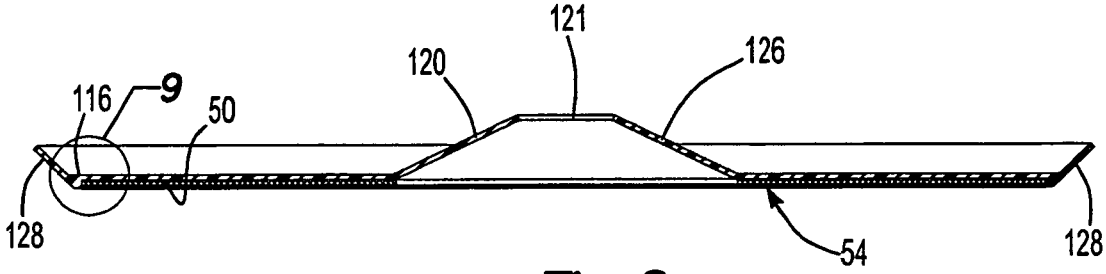
FIG. 8 is a cross-sectional view of an alternate embodiment of the invention; and, FIG. 9 is an enlarged fragmentary view of the embodiment shown in FIG. 8.
Figure 9:
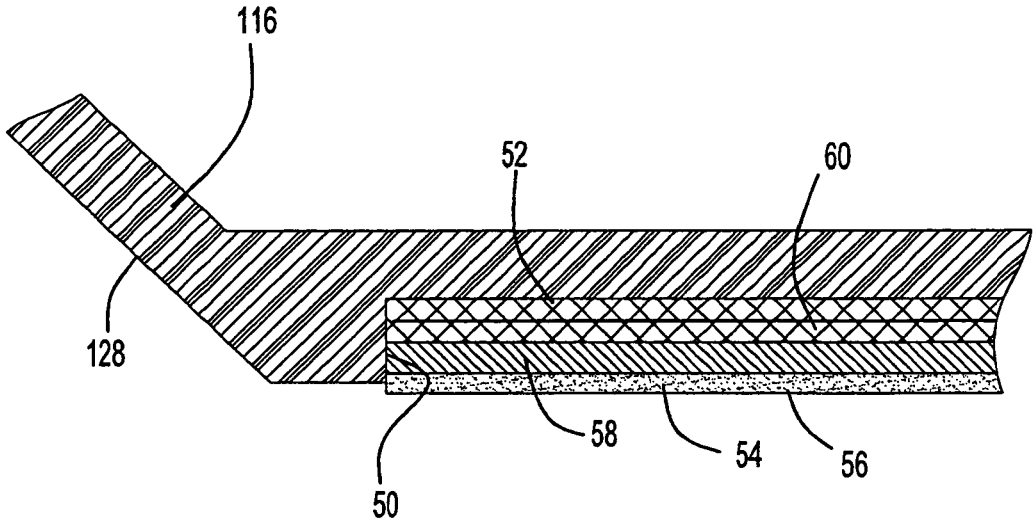

Another embodiment is shown in FIGS. 8 and 9. In this embodiment, the backing plate 116 is a plastic housing with beveled periphery 128, a center pocket 50 within the periphery 128 and beveled center area 120 with center aperture 121. A backing layer of Velcro™ or other hook and loop fastener 52 is adhered in the pocket 50. An abrasive sandpaper 54 having an abrasive layer 56, a paper substrate 58 and a Velcro™ backing 60 are positioned and that the Velcro™ backing 60 engages the complementary Velcro™ backing 52. The depth of the pocket 50 and the thickness of the layers 52, 56, 58 and 60 are coordinate of such that only the abrasive layer 56 is exposed below the beveled periphery 128.

In this way, the beveled periphery 128 provides for the backing plate 116 to ride over any raised edges 45 and position the sandpaper such that only its exposed abrasive layer 56 hits the edge 45 laterally which enables the sandpaper to also ride over the edge 45. The sandpaper substrate layer 58 is protected by the periphery 128.

In this embodiment, the backing plate 116 has similar aperture 126 to receive lugs 18 of the driver. The lugs provide a positive drive between the driver and backing plate 116 and prevent any slipping in either the forward or reverse directions, i.e. clockwise or counterclockwise rotation by having the sides of the lugs 18 abut both sides of the apertures 26 simultaneously. The Velcro™ hook and loop connection provide a non-slip connection between the backing plate 116 and the sandpaper 54.

In this fashion, both the durability and the efficiency of the sandpaper is increased.

Other variations and modifications are possible without departing from the scope and spirit of the present invention as defined by the appended claims.

The embodiments in which an exclusive property or privilege is claimed are defined as follows:

1. An abrasive sandpaper system for a power tool comprising:

a backing plate constructed to be mounted on a driver of said power tool with a positive interlocking device;

a substrate being semi-rigid to retain its shape when not flexed under load and removably mountable to said backing plate;

said substrate having an abrasive surface being made from hard grit particles being affixed onto said substrate;

said interlocking device comprises said backing plate having at least one off-centered aperture sized to interlock with complementarily shaped and similarily sized off-centered lugs on said driver such that the lug abuts both radial sides of the aperture; and a central screw for clamping the backing plate onto said driver and securing said lugs into said apertures.

2. An abrasive sandpaper system as defined in claim 1 further comprising:

the lug's height being no greater than the aperture's height of said backing plate.

3. An abrasive sandpaper system as defined claim 1 further comprising:

said backing plate and said substrate having complementary hook and loop fasteners to non-slidably and removably fasten the substrate to the backing plate.

4. An abrasive sandpaper system as defined in claim 3 further comprising:

said backing plated and said substrate both having a periphery canted away from said abrasive surface.

* * * * *